United States Patent [19]

Porter

[11] 4,163,412

[45] Aug. 7, 1979

[54] FLUID CYLINDER CONTROL WITH PRECISION STOP ACTION

[75] Inventor: Ralph D. Porter, Euclid, Ohio

[73] Assignee: Towmotor Corporation, Mentor, Ohio

[21] Appl. No.: 839,053

[22] Filed: Oct. 3, 1977

[51] Int. Cl.[2] ..... F15B 13/042

[52] U.S. Cl. ..... 91/451; 137/115; 138/31

[58] Field of Search ..... 91/451, 468; 60/418; 137/115; 138/30, 31

[56] References Cited

U.S. PATENT DOCUMENTS

| | | | |
|---|---|---|---|
| 1,776,937 | 9/1930 | Timbs et al. | 138/31 |
| 2,773,511 | 12/1956 | Mercier | 138/30 |
| 3,015,345 | 1/1962 | Michael | 138/31 |
| 3,173,447 | 3/1965 | Lebow | 138/31 X |
| 3,202,060 | 8/1965 | Grotness | 91/443 |
| 3,726,103 | 4/1973 | Anderson | 62/117 |
| 3,774,726 | 11/1973 | Bredberg | 91/451 X |

*Primary Examiner*—Irwin C. Cohen
*Attorney, Agent, or Firm*—Phillips, Moore, Weissenberger, Lempio & Majestic

[57] ABSTRACT

A control system for a fluid pressure-actuated cylinder or the like includes a pump supplying fluid from a reservoir to a control valve which may be selectively operated to cause cylinder extension or retraction and to immobilize the cylinder at a selected position. A unidirectional flow device connects an accumulator to the flow passage between the control valve and cylinder to smooth pressure fluctuations which can otherwise occur when the control valve is closed and which can otherwise produce erratic cylinder motions. Means are provided to relieve excessive pressure in the accumulator, at times when the control valve is shifted to release fluid from the cylinder, without in the process causing unwanted cylinder drift from feedback of the fluid from the accumulator to the cylinder. The excess accumulator pressure is vented to the reservoir through a pilot-operated check valve which is responsive to the pressure differential across the unidirectional flow device in order to allow communication between the accumulator and the reservoir but only when the pressure in the passage between the control valve and cylinder is less than that in the accumulator by a predetermined amount.

6 Claims, 1 Drawing Figure

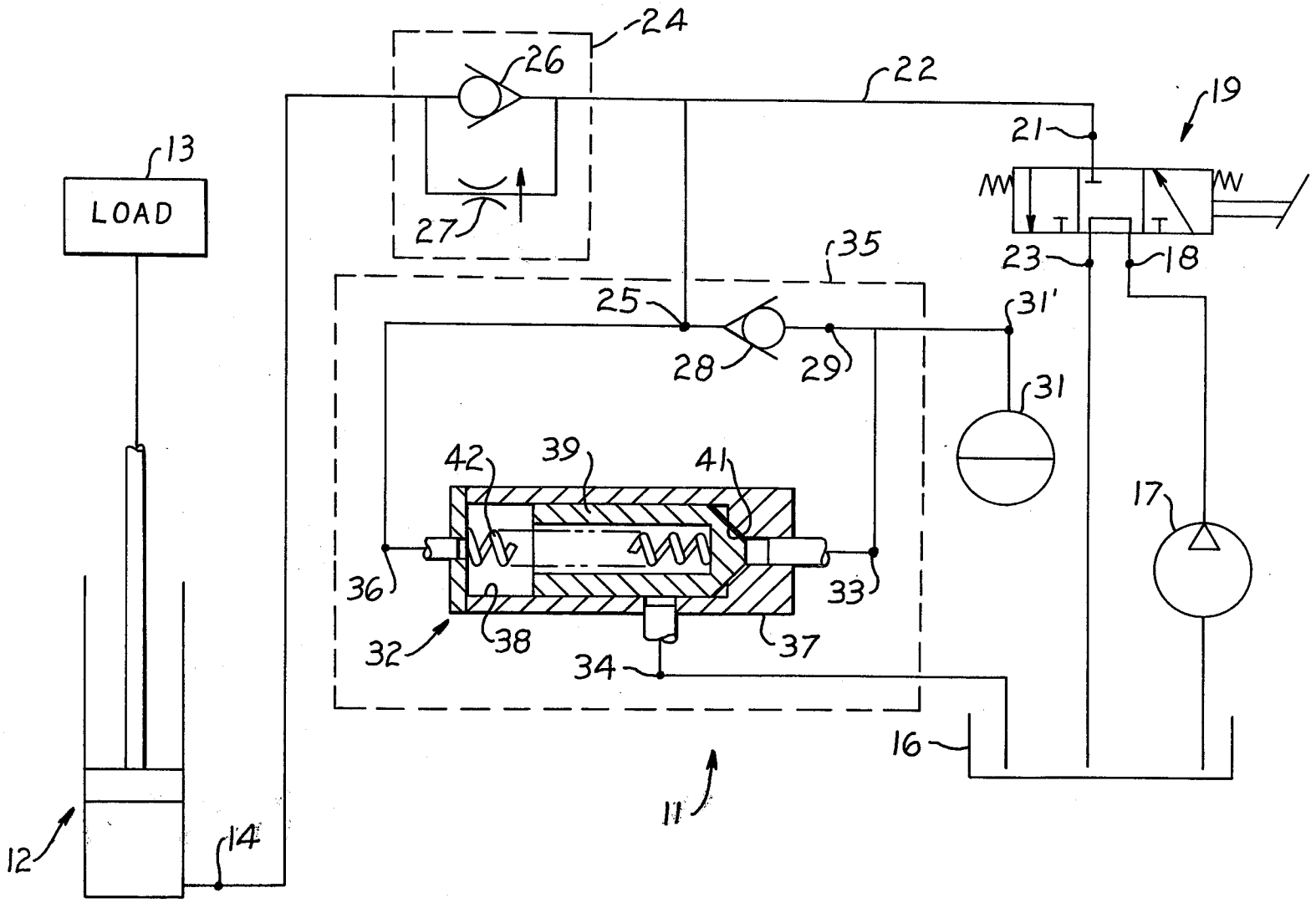
LOAD
11
12
13
14
16
17
18
19
21
22
23
24
25
26
27
28
29
31
31'
32
33
34
35
36
37
38
39
41
42

FLUID CYLINDER CONTROL WITH PRECISION STOP ACTION

BACKGROUND OF THE INVENTION

This invention relates to hydraulic circuits for controlling a fluid pressure-operated cylinder, motor or the like and more particularly to systems of this kind which utilize an accumulator to reduce pressure fluctuations which can otherwise interfere with precise control of the fluid motor operation.

Fluid pressure-operated cylinders, actuators or other forms of fluid motor usually have a control system with a control valve through which pressurized fluid from a pump and reservoir may be selectively transmitted to one or more fluid ports of the cylinder and through which fluid may be selectively released from one or more of the cylinder ports in order to actuate and deactuate the device. The fluid cylinder moves a load, such as the load-supporting forks of an industrial lift truck as one example, under conditions where precise positioning of the load by operation of the cylinder may be a highly important consideration. The operator should be able to stop the cylinder smoothly and quickly at a precise point and without bounce or other erratic cylinder motions. Thereafter the cylinder should remain precisely fixed, without creep-up or other forms of drift, until the control valve is again operated.

To aid in realizing this objective it is a known practice to couple an accumulator to the fluid supply passage between the control valve and the cylinder through a unidirectional flow device connected in parallel with a flow restriction. This aids in reducing unwanted pressure fluctuations and surges which can arise upon closing of the control valve to stop cylinder operation. It uncorrected for, such pressure fluctuations can result in a phenomenon known as bounce which causes erratic unwanted cylinder motion and which interferes with precision control of the point at which the cylinder stops upon closing of the control valve.

In these prior systems the excess pressure which could otherwise build up in the accumulator in the process of smoothing out such pressure fluctuations is slowly fed back to the supply passage between the control valve and cylinder through the above-mentioned flow restriction. While the accumulator, the unidirectional flow device and the flow restriction are effective for the intended purpose of alleviating bounce and other undesirable pressure-fluctuation effects, these elements have been found to contribute to a different undesirable effect, known as creep-up, which also interferes with positional stability of the cylinder.

In particular, after the control valve has been closed with the intention of immobilizing the cylinder and load, the excess high pressure from the accumulator slowly feeds back to the cylinder through the flow restriction and causes cylinder movement away from the exact position at which the operator stopped cylinder operation. In other words, drift or creep-up may occur during the period that the control valve is closed. Thus these prior systems alleviate one effect which could interfere with precision control of the cylinder, but in the process another effect is introduced which itself detracts from the desired result.

SUMMARY OF THE INVENTION

The present invention is directed to overcoming one or more of the problems as set forth above.

According to the present invention, an accumulator is coupled to the fluid supply passage to a fluid cylinder or the like through a unidirectional flow device in order to absorb momentary pressure surges when the control valve is operated. This alleviates bounce and other adverse effects which can arise from such surges. Unlike the above-described prior systems, excess accumulator pressure is not later fed back into the cylinder. Instead, excess accumulator pressure is relieved into the fluid supply reservoir by means which opens only at times when cylinder supply passage pressure is relatively low which condition normally occurs when the cylinder control valve is opened to release fluid from the cylinder into the reservoir.

In one preferred form the accumulator relief means may be a piloted check valve connected between the accumulator and the reservoir and which is responsive to the pressure differential between the accumulator and cylinder supply passage. Pilot pressure from the supply passage holds the piloted check valve closed while high-pressure fluid is being delivered to the cylinder and while the cylinder is immobilized and supporting a load. When the cylinder control valve is shifted to release fluid from the cylinder, pilot pressure drops substantially and the piloted check valve may open to relieve any excess pressure which may have built up in the accumulator during the preceding stages of operation. Thus the accumulator is available to inhibit bounce when the control valve is operated while being protected against excessive pressure build-up without involving a return of the pressure to the supply passage that could lead to cylinder drift.

The invention, together with further objects and advantages thereof, will best be understood by reference to the following description of a preferred embodiment taken in conjunction with the accompanying drawing.

BRIEF DESCRIPTION OF THE DRAWING

The accompanying drawing is a schematic view of a fluid pressure-operated cylinder together with a control system which enables selective extension, retraction and precision positioning of a load coupled to the cylinder.

DESCRIPTION OF A PREFERRED EMBODIMENT

Referring now to the drawing, a control system 11 in accordance with the invention is depicted for purposes of example as utilized to control a fluid pressure-operated cylinder 12 of the form which may be caused to selectively extend and retract in order to translate and position a load 13. The cylinder 12 in this example is of the single-acting form which is positioned to raise the load 13 when pressurized fluid is transmitted to a port 14 at the head end of the cylinder and to lower the load when fluid is released through the port 14, the discharge of fluid being caused by the weight of the load reacting on the cylinder. Fluid cylinders of this particular form are used, for example, as lift cylinders to raise and lower the load-supporting forks or the like of an industrial lift truck. It should be recognized that this specific form of cylinder is but one example of a fluid-operated device with which the control circuit of the present invention may be utilized. The invention may also be adapted to the control of double-acting fluid cylinders and to rotary fluid motors or other fluid-operated devices in which precise control of the positioning of an associated load is desired.

Control system 11 includes a reservoir 16 containing oil or other hydraulic fluid for operating the cylinder 12 and has a pump 17 which pressurizes fluid from the reservoir for delivery to an inlet 18 of a control valve 19. The control valve 19 has a pressurized fluid outlet 21 communicated with a cylinder fluid supply passage conduit 22 and has a drain port 23 communicated with reservoir 16. The control valve 19 may be of any of several known forms depending on the characteristics of the fluid cylinder 12 or other device to be controlled.

In this example control valve 19 is of the manually operated three-position form which is spring-biased to a centered or closed position at which outlet 21 is blocked, to immobilize the cylinder 12, while inlet 18 is communicated to drain port 23. The control valve 19 may be manually shifted to a first open position at which inlet 18 is communicated with outlet 21 to cause the cylinder 12 to extend and lift load 13. Control valve 19 may also be shifted to an alternate open position at which outlet 21 is communicated with drain port 23 to allow fluid to be released from the cylinder 12 in order to lower load 13.

In the particular example of a fluid cylinder 12 depicted in the drawing, extension of the cylinder is resisted by the mass of the load 13. Fluid flow to the cylinder through the control valve 19 and supply passage 22 at such times is opposed by such resistance since the fluid pressure must work against the load. The rate of retraction of the cylinder 12 is not inherently opposed in the same manner and it may be desirable to restrict the discharge flow rate from cylinder 14 to assure that a heavy load 13 does not cause undesirably fast contraction of the cylinder. To cause a greater degree of restriction to be present in the supply passage 22 during the retraction stroke relative to what is present during the extension stroke, a choke and check assembly 24 may be provided in supply passage 22 between control valve 19 and cylinder port 14. Choke and check assembly 24 may typically consist of a check valve 26 connected into supply passage 22 and being oriented to provide an open flow passage when fluid is flowing from control valve 19 to cylinder port 14 but which closes in response to a reversed fluid flow. To establish a more restricted flow path through supply conduit 22 for fluid flow in a reverse direction, the choke and check assembly also includes a flow restriction 27 connected in parallel with check valve 26. Flow restriction 27 is preferably of the adjustable form to enable regulation of the rate of retraction of the cylinder 12 to accommodate to loads 13 of different general magnitudes.

To reduce pressure surges and the resulting cylinder bounce which can otherwise occur, a unidirectional flow device 28 has an inlet 25 connected to supply passage 22 and an outlet 29 connected to the fluid port 31' of an accumulator 31. Unidirectional flow device 28 forms a part of a control means 35 for the accumulator and may be a one-way check valve oriented to provide a fluid flow path from passage 22 to the accumulator 31 when the pressure in the supply passage exceeds that in the accumulator but which closes to isolate the accumulator from the supply passage under reversed relative pressure conditions. Thus when control valve 19 is initially opened, unidirectional flow device 28 opens to enable the pressure in accumulator 31 to build up to the same general level as the pressure in supply passage 22 and cylinder 12. Thereafter, the accumulator 31 functions in the known manner to absorb and reduce momentary excess pressure surges.

In absorbing a momentary excess pressure surge, fluid is recieved into accumulator 31 and the internal pressure in the accumulator rises above the basic system operating level. Unidirectional flow device 28 prevents this high accumulator pressure from being transferred back into the supply passage 22. Thus means must be provided for preventing a sizable build-up of excess pressure in the accumulator 31 after a period of operation as the accumulator would then become progressively less effective for its intended purpose as the pressure in the accumulator built up to a level markedly above that of the normal system operating pressure.

For this purpose relief means are provided for releasing fluid from the accumulator 31 back to reservoir 16 during periods when the accumulator pressure exceeds the pressure within supply passage 22 by a predetermined amount which condition occurs when the control valve 19 is shifted to communicate the supply passage with reservoir 16 in order to lower load 13. This is accomplished without returning fluid from the accumulator back to supply passage 22 in order to prevent unwanted motion of cylinder 12 at times when the control valve 19 is closed. The relief means may preferably be a piloted check valve 32 having an inlet 33 communicated with accumulator port 31' and having an outlet 34 communicated with reservoir 16. Piloted check valve 32 is of the pilot-to-close form in which a fluid pressure supplied to a pilot port 36 acts to bias the check valve towards the closed position. To cause the piloted check valve 32 to be responsive to the fluid pressure differential between accumulator 31 and supply passage 22, pilot port 36 is communicated with the supply passage. Thus the piloted check valve 32 is responsive to the pressure differential across unidirectional flow device 28.

Although other functionally equivalent devices may be used, the pilot-to-close check valve 32 may, for example, have a housing 37 with a bore 38 in which a spool 39 is disposed for axial movement. Inlet 33 communicates with an annular valve seat 41 at one end of bore 38 and a compression spring 42 acts between spool 39 and the opposite end of the bore to urge the spool towards valve seat 41. Pilot port 36 is communicated with the region of bore 38 in which spring 42 is situated and thus the fluid pilot pressure as well as the spring act to bias the check valve 32 towards a closed position at which spool 39 seats in valve seat 41 and blocks any incoming fluid flow from inlet port 33. Outlet 34 communicates with a portion of bore 38 which is occupied by spool 39 when the spool is against valve seat 41 but which is uncovered and communicated with inlet port 33 when the spool is retracted a distance away from the valve seat.

Check valve 32 is held closed during periods when the pressure in supply line 22 exceeds that in the accumulator 31 since the combined forces of the pilot pressure in the bore 38 and spring 42 on spool 39 exceed the counterforce exerted on the other end of the spool at valve seat 41 by accumulator pressure. Check valve 32 opens to relieve excessive accumulator pressure when the force exerted on spool 39 at valve seat 41 by the accumulator pressure exceeds the opposing pilot pressure force combined with the force of spring 42. The accumulator pressure level at which that occurs is determined by the pilot ratio (Pr) of check valve 32 which in this example is:

$$Pr=(P_2A_2+F)/P_1A_1$$

where $A_1$ is the minimum area of valve seat 41, $A_2$ is the cross sectional area of bore 38, F is the force exerted on spool 39 by spring 42, $P_1$ is the accumulator pressure at port 33 and $P_2$ is the pilot pressure at port 36.

In most usages it is preferable that the parameters of the check valve 32 be selected to provide a pilot ratio sufficiently high to keep the check valve closed in the presence of momentary pressure fluctuations in line 22 which may occur at times when control valve 19 is closed to immobilize load 13. If cylinder 12 is the load-supporting cylinder of an industrial lift truck for example, positive and negative pressure fluctuations often occur from jostling of the load as the truck is traveling over a rough surface. If the pilot ratio of valve 32 is too low, each negative pressure fluctuation at such times allows a momentary discharge of fluid from the accumulator. Consequently the accumulator is able to accept fluid from the supply passage 22 during the succeeding positive pressure fluctuation. The net result during a sequence of such pressure fluctuations could be a gradual transfer of fluid from the cylinder 12 to reservoir 16 and an undesirable gradual lowering of the load 13 at a time when it is meant to be immobilized. This is avoided by fixing the pilot ratio at a value which holds check valve 32 closed during normal pressure fluctuations which may be expected to occur in the particular usage of the system at times when the control valve 19 is closed and the load is to be immobilized.

One consequence of the pilot ratio is that under static conditions, with control valve 19 closed to immobilize the load, a somewhat higher pressure may be present in accumulator 31 than in the supply passage 22. This pressure differential is limited to a predetermined maximum value by the excess pressure-relieving action of check valve 32 as herein described. The pressure differential also acts to reinforce the sealing action at unidirectional flow device 28 during periods when cylinder 12 is immobilized.

Accordingly, pressure in accumulator 31 is relieved directly back to reservoir 16 by piloted check valve 32 to the extent necessary to avoid a build-up of accumulator pressure to a level excessively greater than that of supply passage 22. This is accomplished without interfering with the pressure fluctuation-smoothing action of the accumulator and without causing creep-up of the fluid cylinder 12 at a time when it is intended to be mobilized. As there is no open flow path from accumulator 31 back to supply passage 22 at times when the cylinder 12 is intended to be immobilized, positional instability from unwanted motion of the cylinder 12 and load 13 through feedback of accumulator fluid is prevented.

While the invention has been described with respect to a specific exemplary embodiment, it will be apparent that many modifications are possible and it is not intended to limit the invention except as defined in the following claims.

The embodiments of the invention in which an exclusive property or privilege is claimed are defined as follows:

1. A control system for a fluid-operated device comprising:

a fluid reservoir and a pump for pressurizing fluid therefrom, means forming a pressurized fluid supply passage for supplying fluid to a fluid operated device, a control valve having an inlet communicated with said pump and having an outlet communicated with said supply passage and having a drain port communicated with said reservoir, said control valve having at least one open position for transmitting pressurized fluid from said pump to said supply passage and at least one position for transmitting fluid from said supply passage to said drain port, and having at least one closed position at which said supply passage is blocked, an accumulator, and accumulator control means having first means for communicating said supply passage with said accumulator when the pressure in said supply passage exceeds the pressure in said accumulator and for isolating said accumulator from said supply passage while second means relieves excess accumulator pressure to said reservoir during reversed relative pressure conditions, said first and second means each being responsive to pressure differentials between said supply passage and said accumulator.

2. A control system for a fluid-operated device as defined in claim 1 wherein said accumulator control means comprises:

a unidirectional flow device having a fluid inlet communicated with said supply passage and having a fluid outlet communicated with said accumulator, and relief means for releasing fluid from said accumulator to said reservoir during periods when the pressure in said accumulator exceeds the pressure in said supply passage.

3. A control system for a fluid-operated device comprising:

a fluid reservoir and a pump for pressurizing fluid therefrom, means forming a pressurized fluid supply passage for supplying fluid to a fluid operated device, a control valve having an inlet communicated with said pump and having an outlet communicated with said supply passage and having a drain port communicated with said reservoir, said control valve having at least one open position for transmitting pressurized fluid from said pump to said supply passage and at least one position for transmitting fluid from said supply passage to said drain port, and having at least one closed position at which said supply passage is blocked, an accumulator, and accumulator control means for communicating said supply passage with said accumulator when the pressure in said supply passage exceeds the pressure in said accumulator and for isolating said accumulator from said supply passage while relieving excess accumulator pressure to said reservoir during reversed relative pressure conditions wherein said accumulator control means includes a unidirectional flow device having a fluid inlet communicated with said supply passage and having a fluid outlet communicated with said accumulator, and further includes relief means for releasing fluid from said accumulator to said reservoir during periods when the pressure in said accumulator exceeds the pressure in said supply passage, and wherein said relief means for releasing fluid from said accumulator to said reservoir includes a piloted check valve having an inlet in communication with said accumulator and having an outlet in communication with said reservoir and having fluid pressure responsive pilot means for biasing said piloted check valve towards a closed position, said pilot means being in communication with said supply passage.

4. A control system for a fluid-operated device as defined in claim 3 wherein said piloted check valve has a pilot ratio greater than one whereby said piloted check valve is maintained in said closed position when the pressures in said accumulator and said supply passage are equal and opens to release fluid from said accumulator to said reservoir when the pressure in said accumulator exceeds that in said supply passage by a predetermined value.

5. A control system for a fluid-operated device as defined in claim 2 further comprising spring means biasing said piloted check valve towards said closed position.

6. A control system for a fluid-operated device as defined in claim 1 including a fluid operated device wherein said fluid-operated device is an extensible and retractable fluid cylinder having a pressurized fluid port communicated with said supply passage, and wherein said fluid cylinder is a one-way cylinder which extends to move a load against gravitational force in response to receipt of pressurized fluid through said supply passage and which contracts from the reaction of said load in response to the release of fluid through said supply passage, further comprising flow restriction means for limiting discharge flow through said supply passage, said accumulator control means being communicated with said supply passage between said control valve and said flow restriction means.

* * * * *